US008758555B2

(12) United States Patent
Turunen et al.

(10) Patent No.: US 8,758,555 B2
(45) Date of Patent: Jun. 24, 2014

(54) METHOD OF PRODUCING CELLULOSE PULP

(75) Inventors: Esko Turunen, Äänekoski (FI); Kari Kovasin, Rauma (FI)

(73) Assignee: Metsa Fibre Oy, Metsa (FI)

( * ) Notice: Subject to any disclaimer, the term of this patent is extended or adjusted under 35 U.S.C. 154(b) by 0 days.

(21) Appl. No.: 13/530,277

(22) Filed: Jun. 22, 2012

(65) Prior Publication Data

US 2012/0325417 A1 Dec. 27, 2012

(30) Foreign Application Priority Data

Jun. 23, 2011 (FI) ..... 20115659

(51) Int. Cl.
*D21C 3/02* (2006.01)

(52) U.S. Cl.
USPC ..... 162/41

(58) Field of Classification Search
None
See application file for complete search history.

(56) References Cited

U.S. PATENT DOCUMENTS

| | | | | |
|---|---|---|---|---|
| 3,664,919 | A | 5/1972 | Clayton et al. | |
| 6,153,052 | A | 11/2000 | Luthe et al. | |
| 7,828,930 | B2 | 11/2010 | Jiang | |
| 2009/0126883 | A1 * | 5/2009 | Jiang | 162/30.11 |

FOREIGN PATENT DOCUMENTS

| | | | |
|---|---|---|---|
| EP | 1 702 101 | B1 | 9/2006 |
| EP | 1702101 | B1 | 2/2009 |
| WO | 03/057979 | A1 | 7/2003 |
| WO | 03057979 | A1 | 7/2003 |

* cited by examiner

*Primary Examiner* — Jacob Thomas Minskey
(74) *Attorney, Agent, or Firm* — McCormick, Paulding & Huber LLP

(57) ABSTRACT

A method of defibring lignocellulose-bearing raw material with a polysulphide-bearing cooking liquor in a continuous digester. The cooking liquor is mixed into the raw material which is to be defibred before the cooking, and the cooking liquor is allowed to absorb into the raw material at a temperature which is at maximum approximately 130° C. The cooking liquor is then separated from the treated raw material, heated to a temperature of approximately 140-170° C., and mixed back into the treated raw material, possibly together with a fresh feed of cooking liquor, whereby the raw material is defibred to generate pulp which has a desired kappa number.

13 Claims, 2 Drawing Sheets

METHOD OF PRODUCING CELLULOSE PULP

CROSS REFERENCE TO RELATED APPLICATION

Applicant hereby claims foreign priority benefits under U.S.C. §119 from Finnish Patent Application No. 20115659 filed on Jun. 23, 2011, the contents of which are incorporated by reference herein.

TECHNICAL FIELD

The present invention relates to a method of producing cellulose pulp.

BACKGROUND OF THE INVENTION

According to such a method, a lignocellulose-based raw material is cooked in an alkaline cooking liquor which comprises, besides conventional cooking chemicals of sulphate cooking, also polysulphide and antraquinone.

An alkaline cooking liquor which comprises polysulphide is often called orange liquor. Hereinafter, when associated with the present invention, this term is used as a synonym of alkaline cooking liquor which comprises polysulphide.

Use of polysulphide (PS) in combination with antraquinone (AQ) in sulphate pulp cooking, i.e. "PSAQ cooking", is a method which is known and applied industrially. PSAQ cooking is used in about ten factories in the world. PSAQ cooking is particularly suitable to be used together with traditional batch cooking and continuous cooking, because in traditional cooking all the white liquor is dosed at the beginning of the cooking process. In this case, it is possible to fully exploit particularly the effect of increasing the hemicellulose yield of PS at a low temperature in the absorption stage of the cooking.

In the case of modified cooking, the white liquor is dosed in several steps into the cooking process. As in traditional cooking, the first dosing point is at the beginning of the cooking, under low temperature conditions (<120° C.). However, modified cooking is characterised by a substantial part of the alkaline cooking liquor being dosed as hot or in conditions which can easily bring the dose to the cooking temperature, i.e. at a temperature of above 140° C., which decomposes the PS rapidly. This means that the effect of increasing the yield of the PS cannot be exploited as efficiently in modified cooking methods as in traditional cooking, because only part of the alkaline cooking liquor which comprises PS, i.e. of the orange liquor, can be dosed in conditions of low temperature, which are required to increase the yield.

Methods which aim at utilising the PS as efficiently as possible and in a way which suits the process in question in an optimal way have been developed for use in combination with modified cooking.

For example, Metso has filed a patent application for a method by which PSAQ cooking is carried out in a Super Batch batch cooking process (EP 1702101). The same company also has a method of using polysulphide in modified continuous cooking (PCT-patent application WO 2003/057979).

In neither of the Metso methods is it possible to fully exploit the PS effect because several tens of per cents of the alkaline cooking liquor batch are consumed in the actual cooking stage.

Patent application US 2009/0126883, in International Paper (hereinafter "IP"), describes different ways of applying PSAQ cooking in modified continuous cooking. The solution which is described in the IP patent application differs from previous methods associated with PS cooking in that it is possible to dose the entire white liquor dose, which comprises PS, at the beginning of the cooking thereby maximising the improvement in yield. This is enabled by arranging the cooking liquors in such a way that liquors are replaced one by another and the removed liquors are used in later stages of the process.

One liquor is taken out of the boiler but a totally different liquor is brought back. In other words, the liquor which is taken out is directed to a different part of the boiler or removed from the cooking process and, correspondingly, the liquor which is brought back is sourced from a different part of the total process. Consequently, the liquor circulations become in practice very complicated when executed according to the solution in IP.

SUMMARY OF THE INVENTION

The purpose of the present invention is to eliminate at least some of the problems associated with the known technology and to generate a completely new solution for producing cellulose pulp by polysulphide and antraquinone cooking.

In particular, the purpose of the present invention is to generate a method of producing cellulose pulp by using polysulphide/antraquinone cooking in a continuously operating cooking apparatus which is comprised of at least one absorption unit and at least one continuously operating cooking unit, connected in series.

The present invention is based on the principle that the alkaline cooking liquor used is orange liquor (i.e. white liquor which comprises polysulphide) which is produced in a standard way by applying commercially available methods for producing PS liquor. This alkaline cooking liquor is dosed, together with the raw material and AQ, into the input of the absorption unit at a temperature which is elevated but always below 130° C. The absorption process is continued for a period of time, typically at least half an hour, generally at least an hour, in a such a way that it achieves an efficient absorption of orange liquor and effects a stabilising of the hemicellulose of the PS at such temperatures where decomposition of the hemicellulose matrix of the raw material does not essentially take place.

After that, alkaline cooking liquor is separated from the raw material, the temperature of which liquor is increased in a heat exchanger to the cooking temperature, which is, depending on the raw material and the target kappa number, within the range of 140-170° C.

The heated alkaline cooking liquor is recirculated back and directed to the beginning of the actual cooking stage of the raw material, in which case it is possible to rapidly increase the temperature of the wood chips to the temperature required for the cooking stage.

Thus, in the cooking stage, the same alkaline cooking liquor is used which originally was dosed into the input of the absorber, but the temperature of which is increased. The liquor used for absorption is not removed and there is no need to use any new (fresh) liquor for the cooking stage.

More specifically, the method according to the present invention is mainly characterised in that the cooking liquor is mixed before the cooking into the raw material which is to be defibred, the cooking liquor is allowed to absorb into the raw material at a temperature which is at maximum approximately 130° C., after that, cooking liquor used in the absorption is separated from the raw material treated, the separated cooking liquor is heated to a temperature of approximately 140-170° C., after which, the generated hot cooking liquor is, as such, fed back to the treated raw material, the alkaline cooking liquor used in the cooking stage thus being the one which originally was dosed into the absorption process and the temperature of which has been increased, and the raw material is defibred with a hot cooking liquor in order to produce pulp which has a desired kappa number.

Considerable advantages are achieved with the present invention. Thus, in PSAQ cooking, the entire white liquor dosage of the liquor, which comprises PS, can be used at the beginning of the cooking in conditions which are very advantageous and which remove the need for liquor draw-off and circulation into later stages of the process, which actions are used in known solutions. Liquor used for the absorption step is not removed and there is no need to use any new kind of liquor (makeup) for the cooking stage. This enables maximal use of polysulphide in advantageous conditions and the whole arrangement is simple because there is no need to use circulation measures described in generally known techniques. Also, the improvement in yield is substantial, as described in the example below.

The present invention is especially suitable for a process of continuous cooking which has a separate absorption vessel. The adaptations required in the cooking process are only minor, in which case it is easy to carry out cost-efficiently the required implementation in existing cooking areas. If the cooking areas are newly built, the arrangements will not increase the investment costs of the cooking departments compared to a non PSAQ case.

In a preferred embodiment of the present invention, the first part of a continuous cooker (continuous digester), i.e. the first cooking zone, is utilised for prolongation of the absorption process, in which case it is possible to substantially increase the efficiency of the absorption and the capacity of the part of the apparatus used for the absorption. In the case of a traditional vertical continuous digester, the first cooking zone means that part of the cooker which is located above the first screen zone.

In the present invention, only one liquor is circulated in order to reach the cooking temperature quickly. Consequently, there is no need to adjust the alkali profile and it is easier to carry out the cooking process than in the known technology. The cooking process is simple but, at the same time, the whole PS dose is fed in at the beginning of the cooking and undergoes a long absorption.

DESCRIPTION OF THE DRAWINGS

In the following, the present invention will be examined in more detail with the help of a detailed description, wherein.

DETAILED DESCRIPTION OF THE PREFERRED EMBODIMENTS

Figure 1:
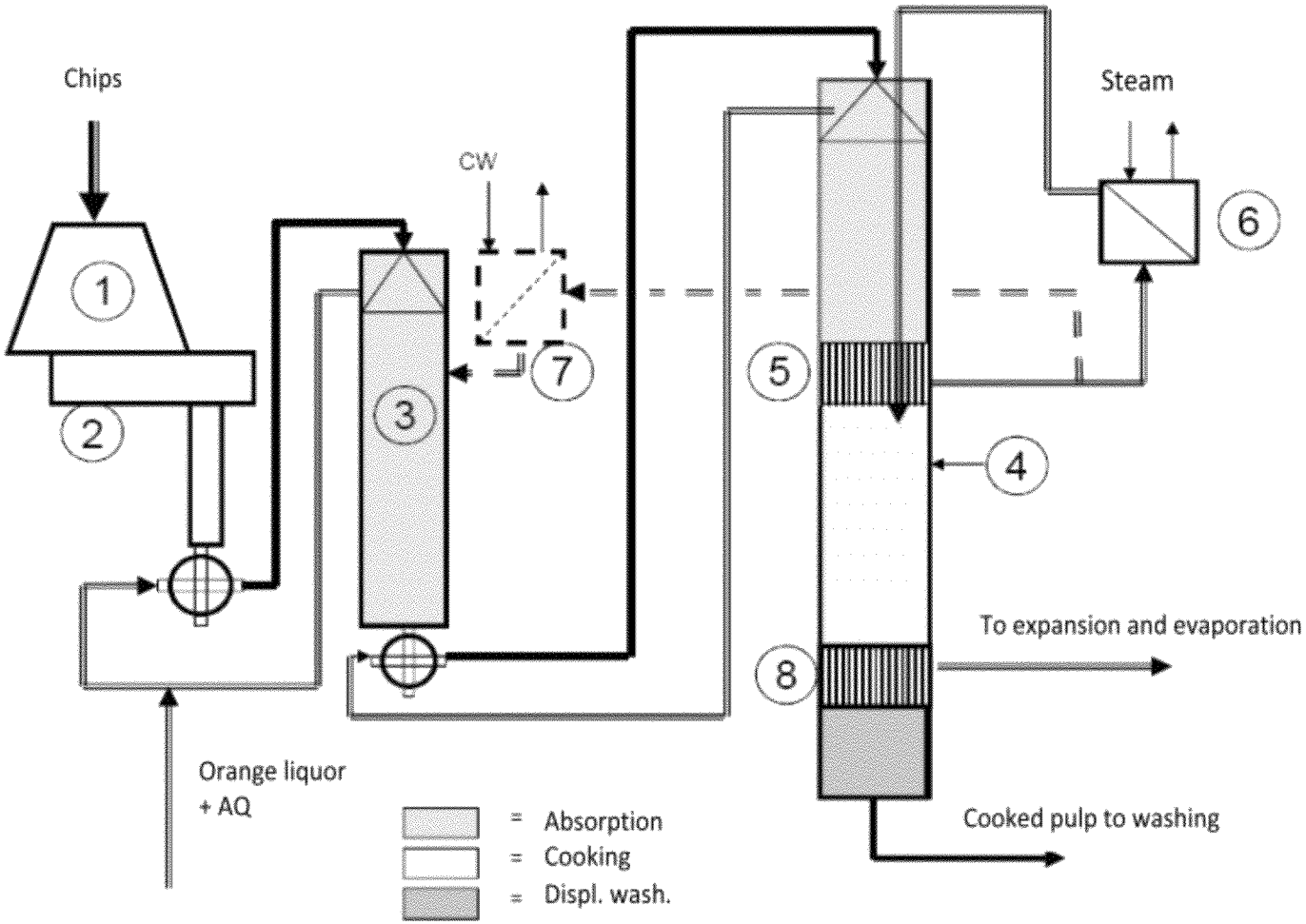
FIG. 1 shows a simplified flow sheet of an embodiment.

As described above, according to a preferred embodiment of the present invention, lignocellulose-bearing raw material is defibred with a polysulphide-bearing cooking liquor in a continuous digester, in which case an alkaline, polysulphide-bearing cooking liquor, which comprises at least a small amount of polysulphide and antraquinone, is used as the cooking liquor and, at the same time, to impregnate the wood chips.

"Polysulphide" is a compound which is generally known in the field and it can be assumed to mean sulphide compounds which comprise elementary sulphur. Typically, elementary sulphur is generated by oxidising 2-valency sulphur.

It is possible to increase the yield by means of polysulphide. Also, the addition of antraquinone into an alkaline cooking liquor improves the removal of lignin and increases the yield. These components have a mutual synergy. Generally, approximately 0.5-1 kg of AQ/tonne of pulp is added. The concentration of polysulphide compounds in the cooking liquor is a few grams per liter, for instance approximately 1-10 g/liter, preferably 2-8 g/liter, especially 5-7 g/liter (calculated from the amount of sulphur). For example, a kappa number of 60 has resulted in a yield improvement of over 2% when the polysulphide dose has been approximately 0.8%, and, correspondingly, the antraquinone dose approximately 0.03% of the amount of wood.

The method can be used with kappa numbers within the range of 10-100. The method makes it possible to selectively separate out the lignin, which makes it possible to use the method to produce paper pulp, in which case the kappa number can be set somewhere within the range of approximately 20-35, but also the cooking can be stopped early, in which case the pulp can be used, after possible bleaching, to produce also paper and cardboard qualities with kappa numbers of 40 or above, or even up to 100.

According to the present invention, the following ingredients are mixed with each other in the first stage

- orange liquor, i.e. white liquor-cooking liquor, to which polysulphide compounds are added,
- antraquinone, and
- raw material to be defibred (typically wood chips), after which the cooking liquor is left to absorb into the raw material at a temperature which is a maximum of approximately 130° C.

According to a preferred embodiment, cooking liquor is absorbed into the raw material at a temperature which is approximately 80-125° C. The time spent for the absorption is, depending on the raw material and the concentration of the absorption solution, at least approximately 10 minutes, especially at least 30 minutes, for instance approximately 45 minutes to 10 hours, most suitably approximately 1-5 hours. The conditions of the absorption process are chosen in such a way that the cellulose matrix does not essentially decompose as a result of the treatment.

Cooking liquor used for the absorption is separated from the raw material which is treated in this way. The separated cooking liquor is heated to a temperature of approximately 140-170° C., after which the hot cooking liquor generated in this way is again mixed with the treated raw material, optionally together with a fresh feed of cooking liquor—although the addition of makeup chemicals is not necessay, and the raw material is defibred with hot cooking liquor in a continuous digester, in order to produce pulp with a desired kappa number.

Thus, in the cooking stage, the same alkaline cooking liquor is used which originally was dosed into the absorption solution, but the temperature of which has been increased; absorption liquor is not removed, nor are substantial volumes of fresh liquor fed into the cooking. Any fresh liquor feed is mainly used to set the alkali level of the alkaline cooking liquor. Thus, the circulated absorption liquor generally forms at least 90%, most suitably 95-100% of the effective alkali dose of the cooking liquor.

According to a more preferable embodiment, the raw material is defibred in a traditional continuous digester which is comprised of an elongated cooking unit (flow-through reactor), which has a vertical central axis, and a first cooking zone into which the raw material can be fed and the bottom of which is formed of a first screen zone, and one or several other cooking zones, which are arranged below the first screen zone. The input and the output can be arranged to form a continuous process.

A continuous digester of this type was developed already approximately 50 years ago. The accompanying drawing is a basic drawing of how the present solution can be applied particularly to a continuous digester of this type.

The apparatus is comprised of:

| | |
|---|---|
| Treatment stage of wood chips | reference numbers 1 and 2 |
| Absorption unit of wood chips | 3 |
| Cooker | 4 |
| First screen zone (upper screens) | 5 |
| Second screen zone | 8 |
| Heat exchangers | 6, 7 |

At the beginning of the cooking process, the wood chips are fed into the cooking apparatus by a standard and well-known method. The figure shows a well-known method which includes a wood chip silo 1, where typically pre-steaming takes place by applying steam which is expanded from liquor. After that, the steaming is continued further in a known way in a steaming vessel 2. The purpose of the steaming is to remove air from the wood chips and to preheat the wood chips for the cooking process, which is a standard and known way of starting the cooking process. Following the steaming, the temperature of the wood chips is typically 90-100° C.

The steamed wood chips are then directed into the absorption vessel 3 by using known methods, such as a wood chip feeder (trigger) or a wood chip pump (for instance TURBO-FEED, which equipment is supplied by Andritz).

Characteristic of the method according to the present invention is that the whole alkaline cooking liquor dose of PS-bearing orange liquor and antraquinone (AQ) is fed together with the wood chips into the absorption vessel 3.

Furthermore, it is possible to bring "fill liquor", for instance washer room filtrate, into the input stream of the absorption vessel. This is not shown in the figure but for continuously operating cooking processes this is a standard way of adjusting the liquid-wood ratio of the absorption process.

The temperature prevailing in the absorption vessel 3 is <130° C., preferably <110° C., most suitably <100° C. A typical lower limit of the temperature range is approximately 75° C. The wood chips and the absorption solution are moved at this temperature to the upper part of the actual cooking vessel 4, where the process of absorption continues as far as to the upper screen 5 of the cooking vessel. In the diagram, the absorption stage is shown in a mid-grey colour. The process of absorption lasts a few hours, typically 3 hours and at least half an hour, preferably at least 2 hours.

In this way, it is possible to achieve a very efficient absorption of the orange liquor, and to effect a stabilising of the hemicelluloses of PS, at temperature conditions which are as advantageous as possible.

Liquor at the end of the absorption stage described above is sucked from the screens 5. The liquor is directed to the heating-heat exchanger 6 where the temperature of the liquor is increased to cooking temperature by applying steam. The cooking temperature depends on the wood raw material, the desired intensity of the cooking (kappa number), the dwelling time in the cooking zone etc, but typically it is >150° C. for softwood raw materials. For hardwood raw materials, the temperature can in some cases be <150° C.

The heated liquor inventory is brought back to the cooking vessel through the upper end via the centre pipe to the levels of the screens 5. The heating circulation and the heat exchanger (6) are dimensioned in such a way that it is possible to increase the temperature of the soaked wood chips to the desired cooking temperature.

From the heated circulation it is possible to abstract a separate side stream (marked with a dashed line in the figure) which is returned to the absorption vessel, where the liquid-wood ratio is adjusted. This liquor stream can be cooled with a heat exchanger 7, as shown in the diagram—or heated—depending on the desired setting temperature of the absorption vessel.

The cooking stage is indicated in light grey in the diagram. The cooking stage and the subsequent wash displacement stage (dark grey) are carried out in a way which is typical of continuous cooking processes. The wash displacement usually comprises a "wash rotation" (not marked in the diagram). The displaced alkaline cooking liquor (expansion liquor) which is to be withdrawn from the cooker is removed from the cooker via the screens (8). This liquor can be directed to the expander cyclones and expanded to a lower pressure, as is generally done in continuous cooking processes; alternatively, another type of cooking heat recovery, which is based on liquid-liquid heat exchange, is arranged.

The cooked pulp exits from the bottom end of the cooker and is directed to pulp wash.

The diagram does not show all the liquor circulation flows, nor liquor pumping, but these are details which are not significant for the actual invention.

It is important to note that it is possible, case-specifically, to slightly heat the upper end of the cooking vessel by directly applying steam, as is typical of continuous cooking. However, in this case the temperature must be kept at maximum at 130° C., in order to avoid the polysulphide losing its effect.

The present invention can be applied to both softwood and hardwood chips and mixtures of them. It is also possible to apply the solution to the production of cellulose pulp sourced from annual or perennial plants, such as different grasses.

Although the method according to the present invention is applied in continuous digesters, as described above, the method can also be applied to batch cooking, for example it can be used in traditional batch cooking or modified batch cooking or displacement batch cooking, such as Superbatch cooking.

However, in the case of displacement batch cooking, it is necessary to take into account any limitations occurring in heat recovery solutions that are characteristic of cooking processes of this type.

Example

The cooking method described above has been studied in laboratory conditions using typical Finnish industrial softwood raw material, which is made up of a mixture of pine and spruce, for the raw material. In the example, the study compares the cooking yield and the yield of pulp which is cooked using the same raw material in a traditional way but without polysulphide and antraquinone.

The composition of orange liquor used in PSAQ cookings:

Effective alkali (EA) 115.0 g NaOH/l and sulphidity 35.0

Polysulphide sulphur 7 g/l

The orange liquor was made from factory white liquor, the composition of which was:

Effective alkali 112.8 g/l and sulphidity 44.3

This standard white liquor was also used in the reference cookings of the conventional cooking process.

The PSAQ cookings were carried out using a total alkali (EA) dose of 23.5% of the amount of wood. The AQ dose was 0.05% of the amount of wood. The cooking was carried out in such a way that the whole alkaline cooking liquor dose of orange liquor and the AQ were dosed together with the wood chips into the cooking vessel, whereafter the temperature of the cooker was increased to 110° C. and held at this temperature for a period of 170 minutes. After that, the temperature of the cooker was increased rapidly to the cooking temperature which varied at different test points within the range of 160-165° C., depending on the target value of the cooking kappa number. The holding time at the cooking temperature was always constant, that is 110 minutes. The kappa number varied within the range of 17-32.

The reference cookings were carried out using the same total alkali (EA) dose of the amount of wood. The cooking was carried out in such a way that the white liquor and the wood chips were dosed into the cooking vessel. After that, the temperature of the cooker was increased to the cooking temperature at a rate of 1° C./minute. In all reference cookings, the temperature was 160° C. The cooking time was varied in order to achieve different kappa numbers within the range of 18-29.

Figure 2:
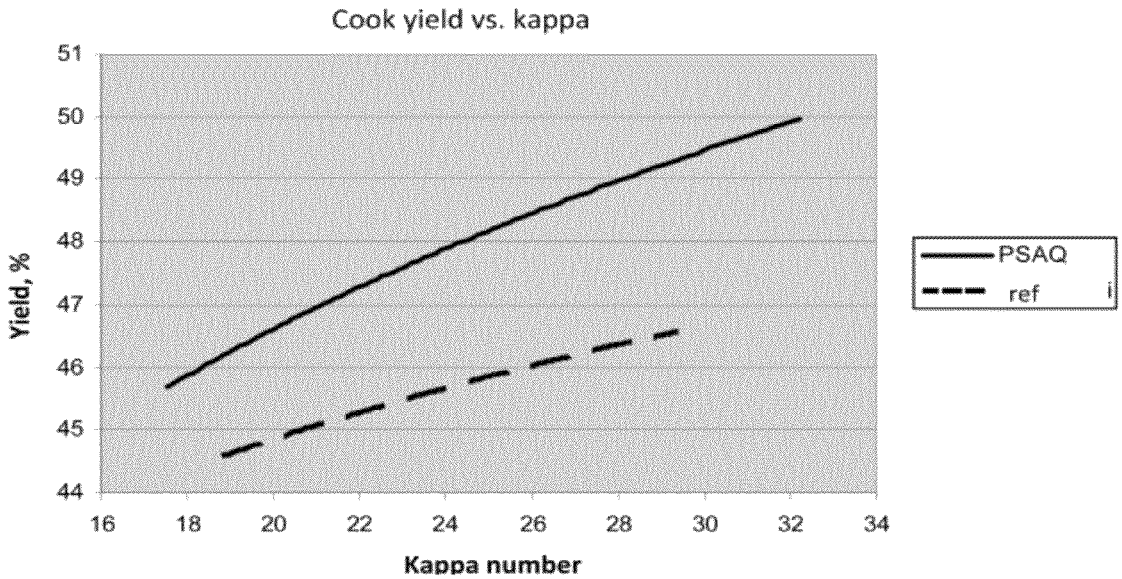
FIG. 2 shows the total yield of the cooking as a function of the kappa number in PSAQ cooking and in a reference cooking.

The accompanying diagram (FIG. 2) shows the total yield of the cooking as a function of the kappa number in a PSAQ cooking and in a reference cooking. It can be seen that improvement in yield is extraordinarily large, i.e. almost 3 percentage points. Also, this shows how advantageous the new method is.

While the present invention has been illustrated and described with respect to a particular embodiment thereof, it should be appreciated by those of ordinary skill in the art that various modifications to this invention may be made without departing from the spirit and scope of the present.

What is claimed is:

1. A method of defibring lignocellulose-bearing raw material using a polysulphide-bearing cooking liquor in a pulp cooker comprising an absorption unit and a cooking unit consisting of the following steps, in order:

mixing the cooking liquor before the cooking into the raw material which is to be defibred in the absorption unit, allowing the cooking liquor to absorb into the raw material at a temperature which is at maximum approximately 130° C., moving the cooking liquor and the treated raw material to the cooking unit, separating the unabsorbed cooking liquor used in the absorption from the treated raw material in the cooking unit, heating the separated cooking liquor to a temperature of approximately 140-170° C., feeding back all the generated hot cooking liquor to the treated raw material in the cooking unit from which it had been separated, the alkaline cooking liquor used in the cooking stage thus being that which was originally mixed with the raw material to be defibred in the absorption unit and forming at least 90% of the effective alkali dose of cooking liquor, and defibering the raw material with the hot cooking liquor in order to produce pulp which has a desired kappa number.

2. The method according to claim 1, wherein liquor is absorbed into the raw material at a temperature which is approximately 80-125° C.

3. The method according to claim 1, wherein cooking liquor is absorbed into the raw material for a period of at least 10 minutes.

4. The method according to claim 1, wherein cooking is carried out in a continuous digester.

5. The method according to claim 1, wherein the raw material is cooked in order to reach a kappa number of 10-100.

6. The method according to claim 1, wherein the cooking is carried out in a batch cooker.

7. The method according to claim 1, wherein the cooking liquor used for absorption is conducted in entirety or essentially in entirety from absorption to the cooking stage, without removing essentially any of it between the absorption stage and the cooking.

8. The method according to claim 1, wherein any makeup of cooking liquor is added to the recycled cooking liquor to adjust the alkali level.

9. The method according to claim 1, wherein cooking liquor is absorbed into the raw material for a period of at least 30 minutes.

10. The method according to claim 1, wherein cooking liquor is absorbed into the raw material for a period of approximately 45 minutes to 10 hours.

11. The method according to claim 1, wherein cooking liquor is absorbed into the raw material for a period of approximately 1 to 5 hours.

12. The method according to claim 1 wherein the cooking liquor used in the absorption unit forms 95% to 100% of the effective alkali dose of the cooking liquor.

13. The method according to claim 1 wherein the cooking liquor used in the absorption unit forms 100% of the effective alkali dose of the cooking liquor.

* * * * *